US006508850B1

(12) United States Patent
Kotliar

(10) Patent No.: US 6,508,850 B1
(45) Date of Patent: Jan. 21, 2003

(54) CLEAN AIR TENT SYSTEM

(76) Inventor: Igor K. Kotliar, P.O. Box 2021, New York, NY (US) 10159-2021

( * ) Notice: Subject to any disclaimer, the term of this patent is extended or adjusted under 35 U.S.C. 154(b) by 18 days.

(21) Appl. No.: 09/713,928

(22) Filed: Nov. 16, 2000

(51) Int. Cl.[7] ..... A61G 10/00

(52) U.S. Cl. ..... 55/385.2; 55/DIG. 8; 55/DIG. 46; 454/187; 128/205.11; 128/205.26; 600/21

(58) Field of Search ..... 55/385.1, 385.2, 55/DIG. 18, DIG. 46; 454/187; 135/116, 119, 127; 128/205.11, 205.26; 600/21

(56) References Cited

U.S. PATENT DOCUMENTS 3,511,162 A * 5/1970 Truhan ..... 55/385.2
4,590,956 A * 5/1986 Griesenbeck ..... 135/116
4,852,598 A * 8/1989 Griesenbeck ..... 135/119
5,487,768 A * 1/1996 Zytka et al. ..... 55/385.2
5,688,297 A * 11/1997 Spencer ..... 55/DIG. 18
5,832,919 A * 11/1998 Kano et al. ..... 128/205.26
5,950,625 A * 9/1999 Bongiovanni et al. ..... 600/21
5,964,222 A * 10/1999 Kotliar ..... 128/205.26
6,235,072 B1 * 5/2001 Kopylov et al. ..... 55/385.2

* cited by examiner

*Primary Examiner*—David A. Simmons
*Assistant Examiner*—Minh-Chau T. Pham
(74) *Attorney, Agent, or Firm*—Hypoxico Inc.

(57) ABSTRACT

A system for providing clean air environments for sleeping, resting, working or exercising in order to provide relieve and therapeutic benefits to people with bronchial asthma and respiratory allergies, such system comprising of a tent or stationary enclosure, an air-pumping device and a HEPA filter that removes dust, bacteria and allergens from air entering tent or enclosure; the air-pumping device can be installed in two different configurations: in air-supply or air-removal mode, in both providing necessary ventilation and supply of clean air for breathing.

15 Claims, 4 Drawing Sheets

CLEAN AIR TENT SYSTEM

RELATED APPLICATIONS

This application is related in part to preceding U.S. Pat. No. 5,964,222 "Hypoxic Tent System" issued Oct. 12, 1999 and U.S. Pat. No. 5,799,652 "Hypoxic Room System and Equipment for Hypoxic Training and Therapy at Standard Atmospheric Pressure" issued Sep. 1, 1998.

FIELD OF THE INVENTION

This invention relates to enclosed clean air environments created for resting in for the purposes of improving health conditions of people with bronchial asthma and respiratory allergies.

Every year more and more people throughout the world become affected by polluted atmosphere and growing number of allergens, especially in urban areas where bronchial asthma and respiratory allergies spread at growing speed. All people with such illnesses would greatly benefit from a possibility to sleep, rest, work or exercise in environments, substantially free of dust mites, bacteria and allergens.

The invention presented here provides a convenient, low cost solution to create such clean air environment for sleeping. This invention makes it possible to make a portable sleeping enclosure that may be easily installed at home or in any hotel room.

The Clean Air Tent System can also be used as a therapeutic device to provide relief during asthma and allergy attacks.

Prior Art

There are many inventions for providing clean air environments by using separate cleaning units installed in a room. The U.S. Pat. No. 5,997,619, Knuth, et al., shows a self contained air purification system with a germicidal chamber. Similar devices are presented in U.S Pat. No. 5,656,242 by Morrow et al., U.S. Pat. No. 5,616,172 by Tuckerman et al., U.S. Pat. No. 5,612,001 by Matschke et al., U.S. Pat. No. 5,399,319 by Schoenberger et al., and many others.

All these and similar inventions describe only one side of a possible solution—they all offer air filtering devices that suppose to clean air while being installed inside a room. Unfortunately, in most cases such devices do not provide effective protection against pollutants entering room from outside, especially in elevator buildings in urban areas. Such buildings must provide positive pressure in elevator shafts by constantly pumping street air inside, forcing large amounts of street dust and allergens into apartments. Air streams caused by such cleaning devices will only make it worse by picking up dust settled on walls, ceiling and furniture.

It is strongly believed that only self-contained environments ventilated by clean air from outside can provide a necessary protection from dust mites, bacteria and allergens. No prior art on such concept was found.

DESCRIPTION OF THE INVENTION

There are two different embodiments of the Clean Air Tent System invented and described in this work.

Figure 1:
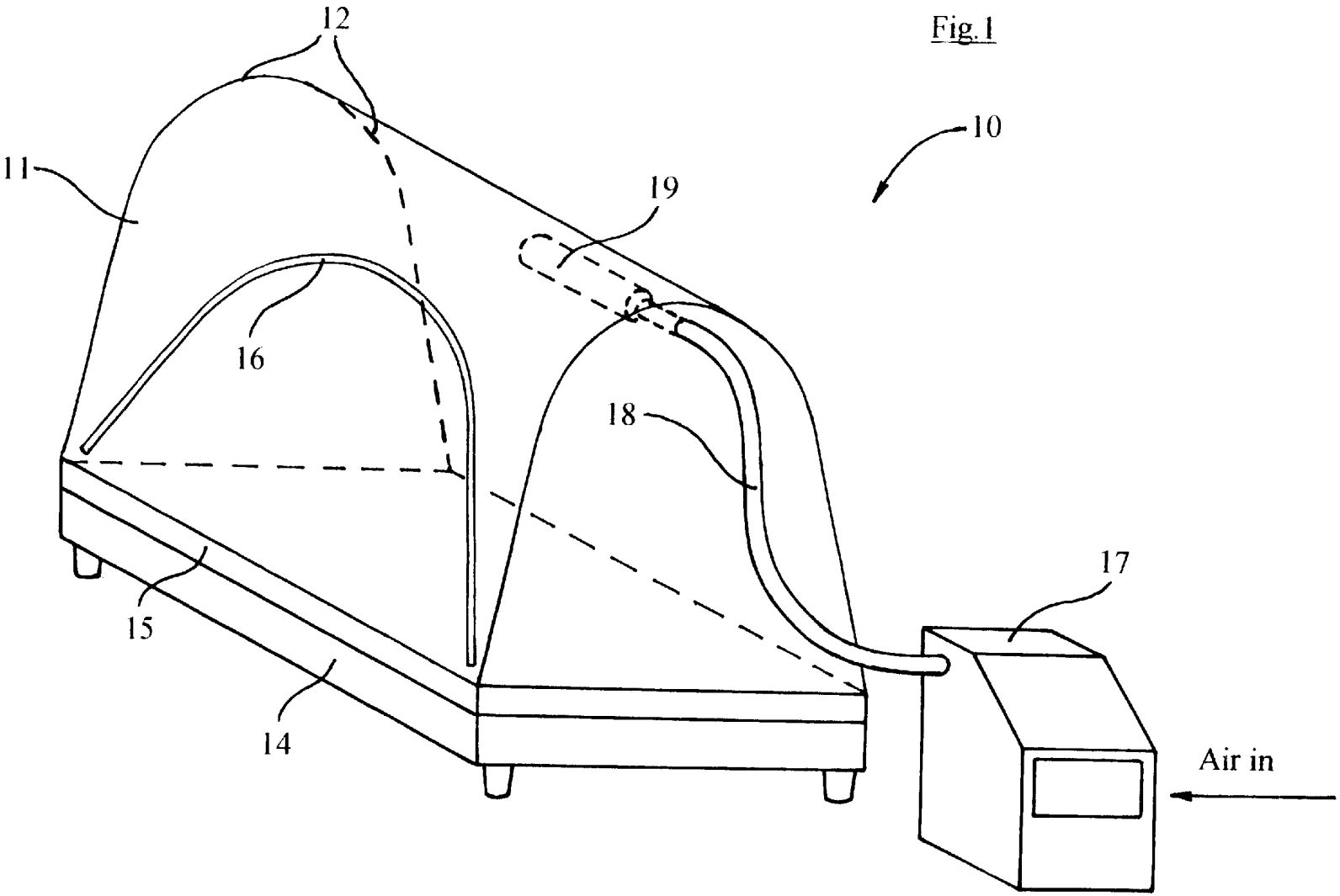

FIG. 1 shows a schematic view of the first preferred embodiment 10. A tent 11 is fitted onto a bed 14 with a mattress portion 15 inside and upheld by supporting structure 12 that is locked onto sleeves on the corners of tent 11.

Tent 11 is made of light, thin fabric such as parachute nylon or synthetic material such as clear polyethylene or combination of both. The most preferred materials are those certified as non-allergic. Tent 11 has an entryway 16, which can be closed preferably by a zipper, magnetic tape or other locking device, openable and closeable from the inside and outside of tent 11. Supporting structure 12 is preferably made from light metal or plastic tubes which can be disassembled in segments. Suitable tents and enclosures of different shapes and sizes are made by Hypoxico Inc., New York, and are sold under the name "Hypoxic Tent" or "Hypoxic Room".

A blower 17 installed outside of the tent supplies ambient air, under slightly higher then atmospheric pressure, into tent 11 through air hose 18 ending with a filter 19 that filters supplied air of airborne particles and bacteria. The most preferred type of filter 19 is a HEPA (High Efficiency Particulate Arrestance) filter, which is widely available from a number of manufacturers including Hypoxico Inc. Such HEPA filter removes 99.97% of particles smaller then 0.2 microns in size (most of bacteria and allergens) and provides almost sterile air for breathing inside the tent 11.

The working principle of this embodiment is quite simple. Blower 17 intakes ambient air and deliver it, via hose 18 and HEPA filter 19 installed inside tent 11. Any oilless blower providing over 100 liters per minute of air is suitable (e.g. from Thomas Industries, GAST Manufacturing, etc.).

Air pressure remains near normal inside tent 11 as a result of air exiting gaps in the tent construction, which does not have to be airtight. For example, air can exit around the zipper or other closing mechanism of entryway 16 and through fabric pores. Additional air escape openings may be provided as well, if necessary.

During sleep an adult person consumes about 10 liters per minute of air for breathing. Providing 100–300 liters per minute (or even more for larger freestanding tents) would guarantee removal of excessive water vapor and carbon dioxide and creating of a comfortable sleeping environment inside tent 11. In most cases, excessive water vapor and carbon dioxide, being much faster than other gases, will quickly diffuse through the fabric of tent 11, but most of it will escape along with exiting air. It means that fabric of the tent might be waterproof and airtight, which makes it more convenient for cleaning.

For hot and humid climates, a split air conditioning unit (not shown) may be installed inside such freestanding tent.

Figure 2:
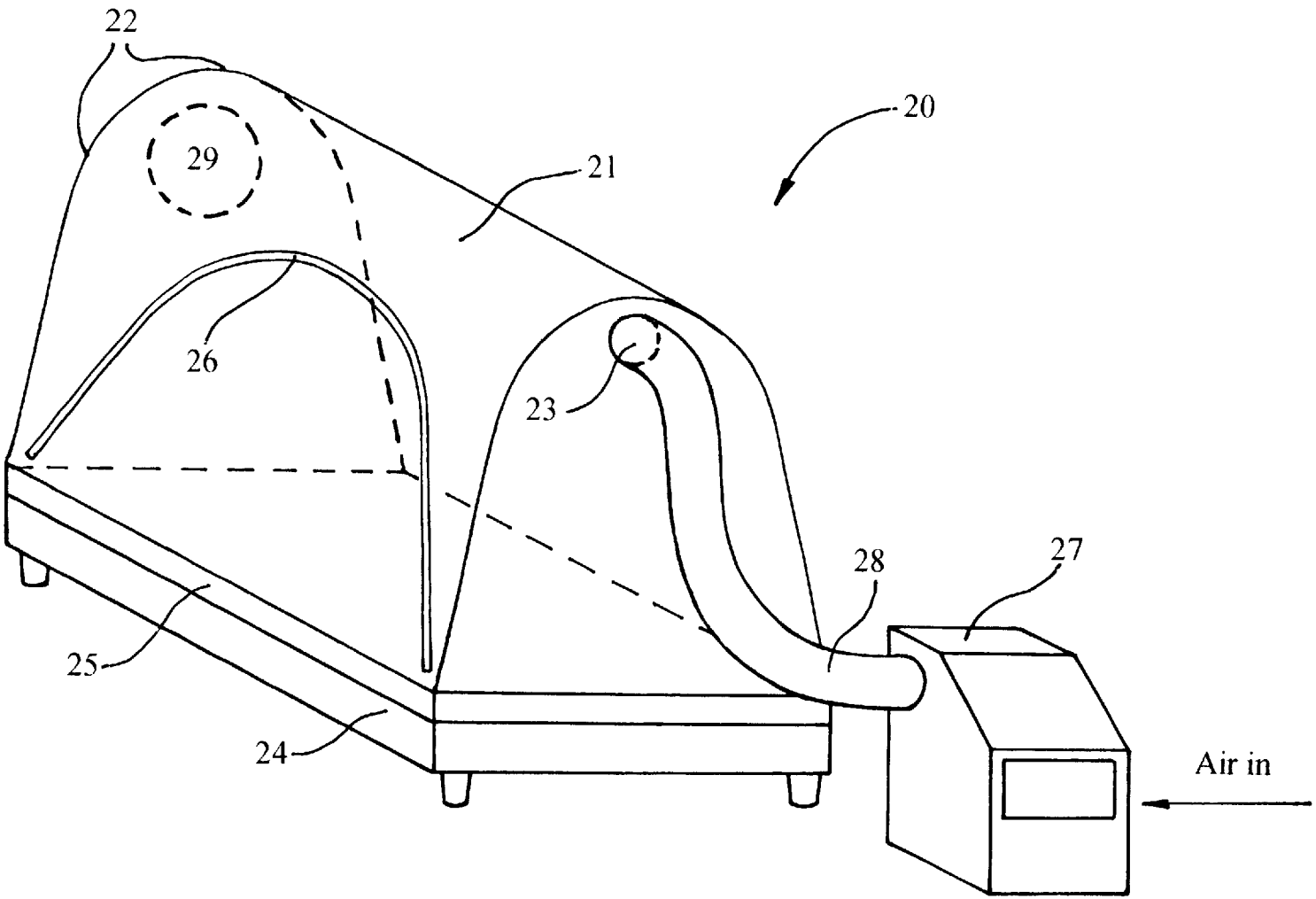

FIG. 2 shows schematically second preferred embodiment 20, wherein the air circulates in opposite direction. Tent 21 having supporting structure 22, and entry 26 is installed on bed support 24 with mattress 25 inside.

Blower or pump 27 draws air from tent 21 via optional hose or conduit 28. Due to pressure difference, ambient air is sucked into tent 21 through a flat HEPA filter 29 that removes most of airborne particles and allergens. The interchangeable filter 29 is installed in a special holder sewn in or embedded into a fabric or plastic wall of tent 21, preferably opposite to the air outlet 30. The rest of the tent 21 should be made as airtight as possible in order to eliminate air intrusion through the gaps. The filtering surface of the filter 29 must be large enough (minimum 200 cm2 for sleeping applications and 600 cm2 for larger tents) to provide less resistance for air entering tent 21.

A cooling or ventilating fan used for computer cabinets can be installed at the outlet 30 instead of the pump 27. There are many types of fixtures available on the market that can be used in order to install HEPA filter 29 and such cooling &m They are well known to those skilled in the art, so there is no need to discuss it further. Such pump or cooling fan should draw at least 100 liters per minute of air from the tent 21 in order to provide a comfortable breathing environment for resting.

There is a variety of highly efficient filter media available on the U.S. market for flat filter 29, both hydrophilic and hydrophobic, with a filtration rate of 0.2 microns and less, which is suitable for this application Appropriate interchangeable filters are available from Hypoxico Inc.

Tents 11 and 21 can also have an inflatable supporting structure instead of the supporting tubing of arches.

Figure 3:
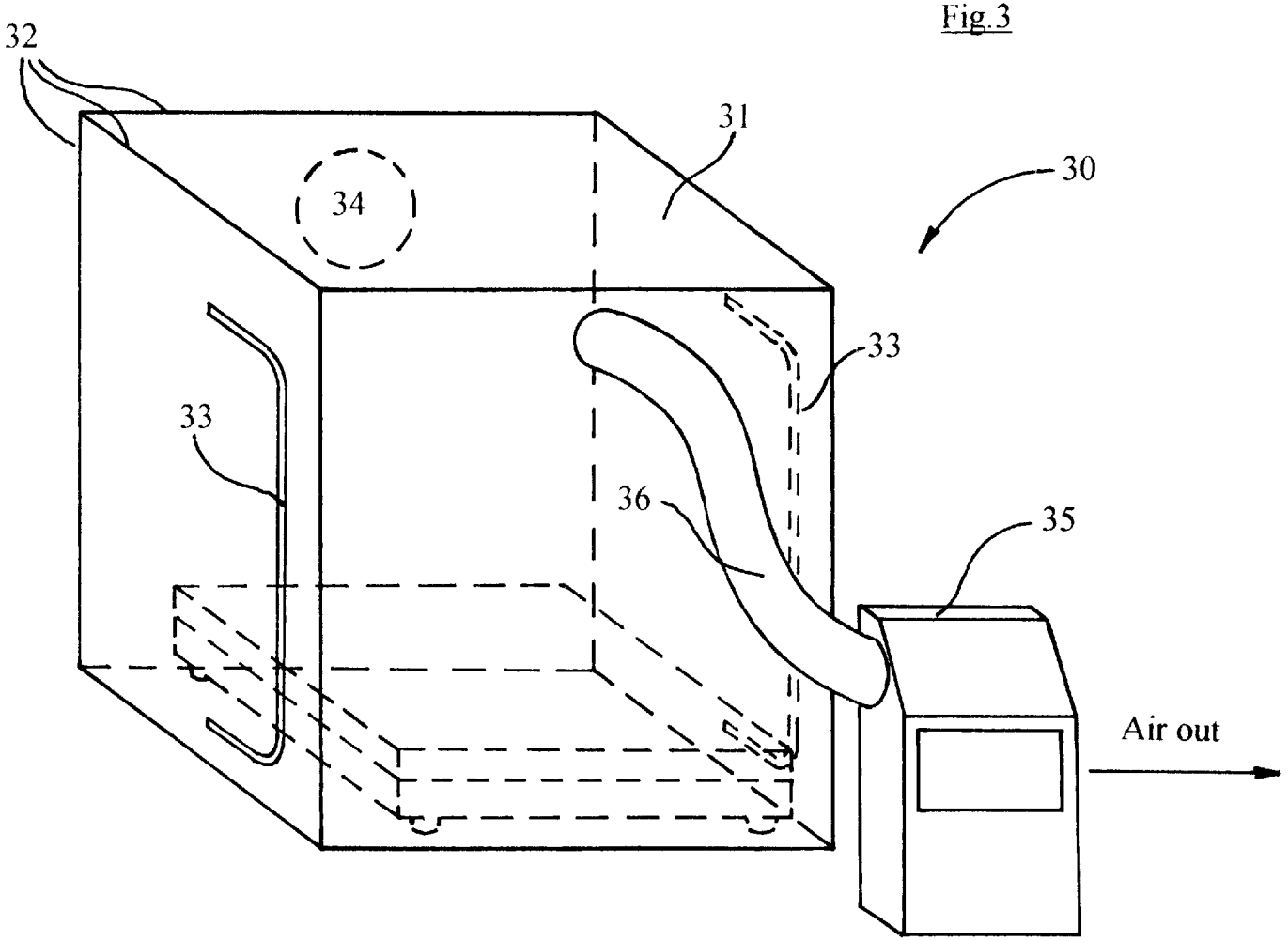

FIG. 3 shows embodiment 30 employing a free standing sleeping tent 31 that is also available from Hypoxico Inc. in New York. It is made for nylon fabric with clear soft walls supported by supporting structure 32 and having two doors 33. Tent 31 can be easily installed in a bedroom with the whole bed inside. Such tent can also be used as a clean working area for people with respiratory problems by installing office furniture and equipment inside. Tent 31 has a volume about 15 m3 and requires a larger air pump or blower 35 with a flow rate preferably above 300 liters per minute supplied to or removed from the tent trough the hose 36. Larger stationary enclosures with a door can also be used for permanent installation at home or hospital Such large tent systems can work in both air supply and air removal modes, shown on FIG. 1 and 2. Tent system 30 is shown in air removal ventilation mode, having flat filter 34.

Figure 4:
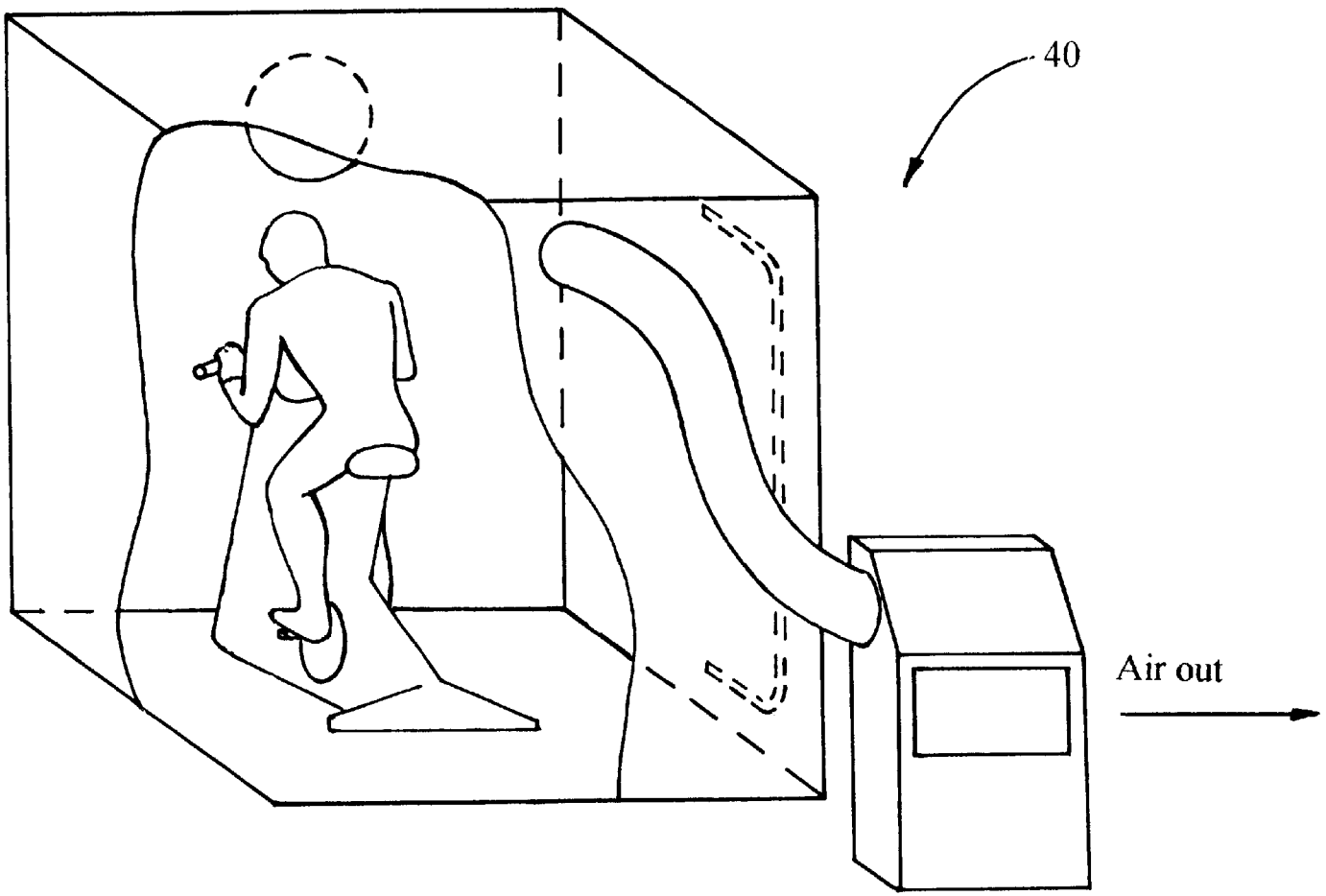

Clean air tent system 40 presented on FIG. 4 is also beneficial for exercising and they can accommodate any piece of fitness equipment inside. During exercising an average adult person consumes up to 20 times more air then at rest (elite athletes up to 40 times!). It means that the amount of dust, bacteria and allergens receiving by pulmonary system in ambient air would increase respectively. That is why it is very important that people with asthma and allergies exercise in clean air tent 40 or similar stationary enclosure. Such tents and enclosures must have air supply devices and HEPA filters rated over 500 liters per minute for home use and over 1000 liters per minute for the use in fitness clubs or other training facilities. Such amounts of clean airflow are needed in order to remove water vapor and carbon dioxide produced by a human body during exercising. A split air-conditioning unit should be installed as well, in order to control temperature and humidity inside exercise tent or enclosure. A working principle of a split a/c unit is well known to those skilled in the art and will be not discussed further.

Clean air tent systems shown on FIG. 1 and 2 can be easily disassembled and packed in luggage or a special travel case.

What is claimed is:

1. A system for providing clean atmosphere for breathing to a user while resting, working or exercising, said system comprising:

a breathing enclosure having an entry that when closed separates internal environment from outside atmosphere;

an air-pumping device having an inlet communicating with said breathing enclosure and an outlet communicating with external atmosphere, so when in use said device intakes air from said internal environment and releases it into atmosphere creating a slightly negative pressure inside said enclosure;

an air cleaning filter being installed in a wall of said breathing enclosure and allowing outside air to enter said breathing enclosure through said filter in amounts equal to amounts of air extracted from said enclosure by the air-pumping device and released into outside atmosphere through said outlet, providing thereby a clean internal environment that is free from airborne particles and allergens.

2. The invention according to claim 1 and said air cleaning filter being interchangeable flat HEPA filter embedded in the wall of said breathing enclosure, preferably opposite to said inlet;

said HEPA filter being hydrophilic or hydrophobic, and removing at least 99.75% of airborne particles larger then 0.2 microns from the air entering said enclosure.

3. The invention according to claim 1 and said air-pumping device being blower or ventilating fan removing from said enclosure at least 100 liters per minute of air for resting or working applications and at least 500 liters per minute for exercising application.

4. The invention according to claim 1 and said entry closable by magnetic tape or locking mechanism, and when closed, dividing said internal space from the external atmosphere.

5. The invention according to claim 1 and said breathing chamber made of soft synthetic or natural material and supported by supporting structure, which may be inflatable or assembled from segments made from metal or plastic material.

6. The invention according to claim 1 and said breathing chamber being attached to resting platform, a bed, allowing user to rest inside said internal space while inhaling purified air.

7. The invention according to claim 1 and said breathing chamber having bed or working area inside being installed on the floor at home, hotel, hospital or fitness facility.

8. The invention according to claim 1 and said breathing chamber having always a slightly negative pressure inside preventing contamination of both external and internal environments.

9. A portable system for providing a clean air environment to a user for breathing, said system comprising:

a breathing tent comprising soft walls supported by a supporting structure and an entry defining a closed space accessible to the user through said entry being selectively closable so that when closed, the tent is substantially isolated from the outside environment;

a air-pumping device having inlet communicating with said breathing tent and extracting internal air from said closed space through said inlet;

a filter incorporated in a wall of the tent and allowing external air to be drawn into the tent due to a negative pressure created inside the tent by said air-pumping device; said filter removing airborne particles and allergens from said external air entering said breathing tent;

said breathing tent being airtight except of the filter, so the amount of air entering the tent from outside being equal to the amount of air extracted from the tent by the air-pumping device.

10. The invention according to claim 9 and said breathing tent designed to be attached to or erected on a resting platform, mattress or bed, allowing the user to rest or sleep inside said tent.

11. The invention according to claim 9 and said portable travel system designed for quick and easy installation and disassembly at home or hotel room.

12. The invention according to claim 9 and said portable system designated for therapeutic use to provide relieve to people with bronchial asthma and respiratory allergies.

13. The invention according to claim 9 and said tent is made of fabric and clear soft plastic material;

said supporting structure made of metal or plastic segments.

14. The invention according to claim 9 and said supporting structure being inflatable to support said breathing tent.

15. The invention according to claim and said portable travel system, which can be disassembled and packed in luggage for travel.

* * * * *